US006945245B1

(12) United States Patent
Wilson

(10) Patent No.: US 6,945,245 B1
(45) Date of Patent: Sep. 20, 2005

(54) TRIVET OVEN RACK

(75) Inventor: Arthur Cameron Wilson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/659,112

(22) Filed: Sep. 11, 2000

Related U.S. Application Data

(60) Provisional application No. 60/153,401, filed on Sep. 10, 1999.

(51) Int. Cl.[7] ..... F24C 15/16

(52) U.S. Cl. ..... 126/337 R; 126/215; 126/333; 126/273 R

(58) Field of Search ..... 126/337 R, 339, 126/215, 333, 337 A, 273 R; 312/410; 211/153, 211/134, 181.1; D7/409

(56) References Cited

U.S. PATENT DOCUMENTS

| | | | | |
|---|---|---|---|---|
| 2,804,068 A | * | 8/1957 | Miller et al. | 126/337 R |
| 3,266,484 A | * | 8/1966 | Carpenter et al. | 126/337 R |
| 3,566,776 A | | 3/1971 | Young et al. | |
| 3,941,968 A | | 3/1976 | MacMaster et al. | |
| 3,977,389 A | * | 8/1976 | Ondrasik, II | 126/337 R |
| D251,106 S | | 2/1979 | Petursson | |
| D260,227 S | | 8/1981 | Bentson | |
| 4,476,848 A | * | 10/1984 | Protas | 126/337 R |
| 4,510,362 A | | 4/1985 | Miller | |
| 4,848,217 A | * | 7/1989 | Koziol | 211/181.1 |
| D308,317 S | | 6/1990 | Koziol | |
| 5,103,799 A | * | 4/1992 | Atanasio | 126/9 R |
| 6,164,194 A | * | 12/2000 | Westmoreland | 99/426 |
| 6,457,594 B1 | * | 10/2002 | Tiemann | 211/181.1 |

FOREIGN PATENT DOCUMENTS

| | | | | |
|---|---|---|---|---|
| DE | 40 23 206 A1 | * | 6/1991 | F24C 15/16 |
| JP | 64-84031 A | * | 3/1989 | F24C 15/16 |

OTHER PUBLICATIONS

Merriam Webster's Collegiate Dictionary, Tenth Edition. Merriam-Webster, Incorporated. 1996, p. 441.*

* cited by examiner

*Primary Examiner*—Josiah C. Cocks
(74) *Attorney, Agent, or Firm*—George L. Rideout, Jr.; Armstrong Teasdale LLP

(57) ABSTRACT

An oven rack for an oven provides includes a first portion and a second portion extending from the first portion. A pair of handles extend from the first portion to permit a user to easily grasp the oven rack. A support system is attached to the oven rack and extends from the first portion to contact a bottom surface of a cooking chamber when the oven rack is installed in the oven and permits the oven rack to be used as a countertop trivet rack. An oven rack is provided which increases the cooking capacity of the cooking chamber.

17 Claims, 4 Drawing Sheets

TRIVET OVEN RACK

CROSS REFERENCE TO RELATED APPLICATIONS

This application claims the benefit of U.S. Provisional Application No. 60/153,401, filed Sep. 10, 1999

BACKGROUND OF THE INVENTION

This invention relates generally to ovens and, more particularly, to oven racks positioned within an oven cooking chamber.

When consumers cook food in an oven, the amount and size of the food that can be cooked is limited by the capacity of the oven. Bake ovens typically include an oven cooking chamber configured to receive a pair of wire oven racks. The oven racks rest on pre-formed shelves when the oven racks are inserted within the cooking chamber. The pre-formed shelves are disposed within the sidewalls of the cooking chamber. The position of the oven racks within the cooking chamber is limited by the location of the pre-formed shelves. Typically, the oven rack shelve closest to a bottom surface of the cooking chamber is several inches above the cooking chamber bottom surface. As a result of the pre-formed shelves, the oven racks are limited to being positioned at least several inches above the cooking chamber bottom surface in a spaced relationship from the flat bottom surface of the cooking chamber. Therefore, because a portion of the cooking chamber is not configured to receive oven racks, a portion of the cooking chamber is under-utilized.

BRIEF SUMMARY OF THE INVENTION

In an exemplary embodiment of the invention, a wire oven rack is configured to contact a cooking chamber bottom surface when the wire oven rack is installed in an oven. The wire oven rack includes a first portion and a second portion extending unitarily from the first portion. A pair of handles extend from the first portion and permit a user to easily grasp the oven rack while inserting or removing the oven rack from an oven. Additionally, a support system extends from the first portion and is configured to contact a bottom surface of a cooking chamber when the oven rack is installed in the oven. Thus, when installed in the oven cooking chamber, the oven rack is positioned below the pre-formed shelves disposed within the side walls of known oven cooking chambers. As a result, by permitting a user to install an oven rack below the pre-formed shelving, a capacity of the cooking chamber is increased with the oven rack. Accordingly, a cost-effective oven rack is provided which increases the flexibility and the cooking capacity available to a user.

DETAILED DESCRIPTION OF THE INVENTION

Figure 1:
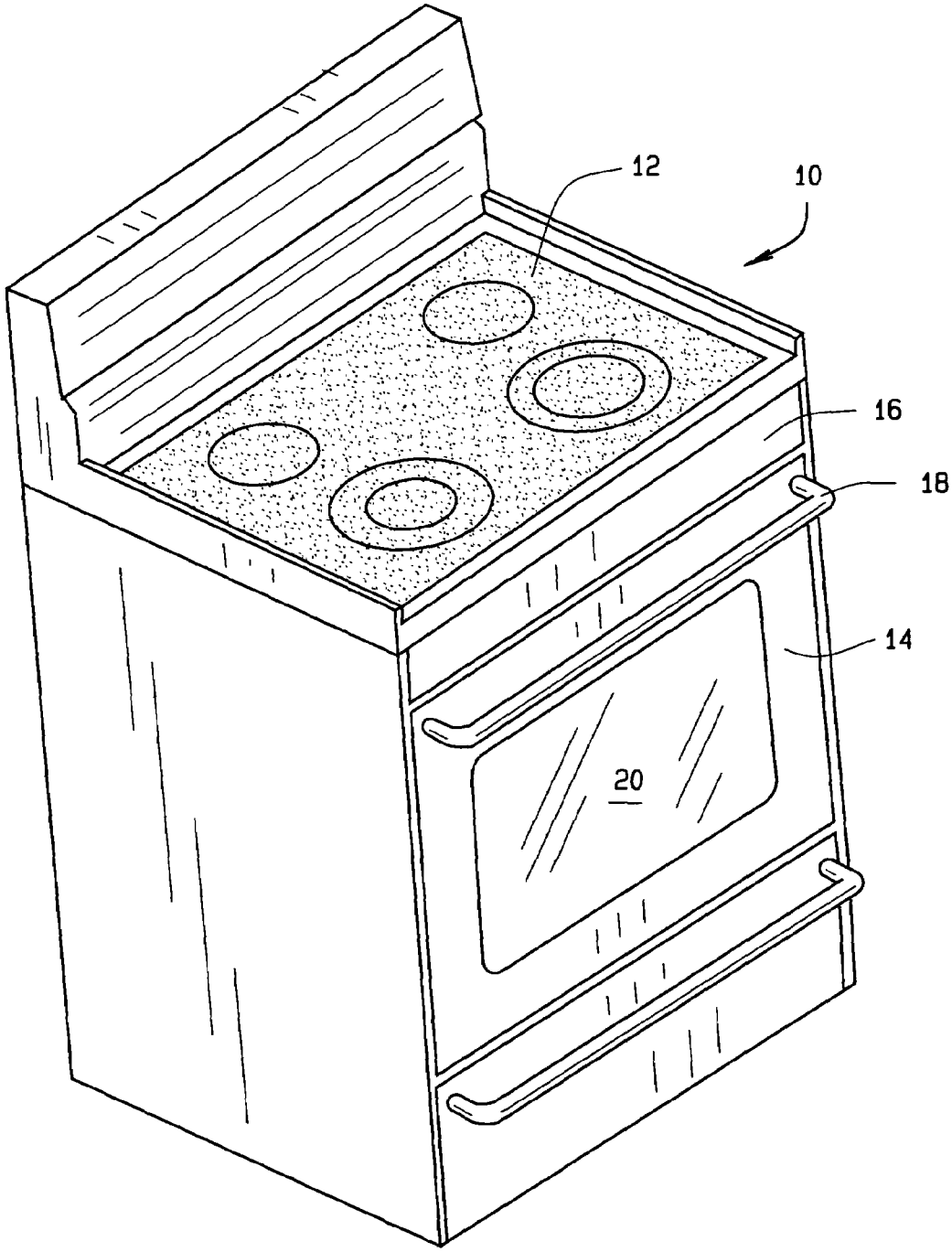
FIG. 1 is a perspective view of an oven including an oven chamber for receiving an oven rack.

FIG. 1 is a perspective view of an oven 10 including a top surface 12 and a front door 14. Front door 14 is hingedly attached to a front surface 16 and is pivotable to selectively open and close with a handle 18 to access a cooking chamber (not shown in FIG. 1). Door 14 includes a window 20 to permit a user to visually inspect the cooking chamber. The cooking chamber includes a substantially flat bottom surface (not shown in FIG. 1), a top surface (not shown in FIG. 1) connected to the bottom surface with a pair of side walls (not shown in FIG. 1), and a back wall (not shown in FIG. 1) extending between the pair of side walls and between the top and bottom surfaces. The side walls include a plurality of pre-formed shelving slots (not shown in FIG. 1) to receive cooking racks (not shown).

Figure 2:
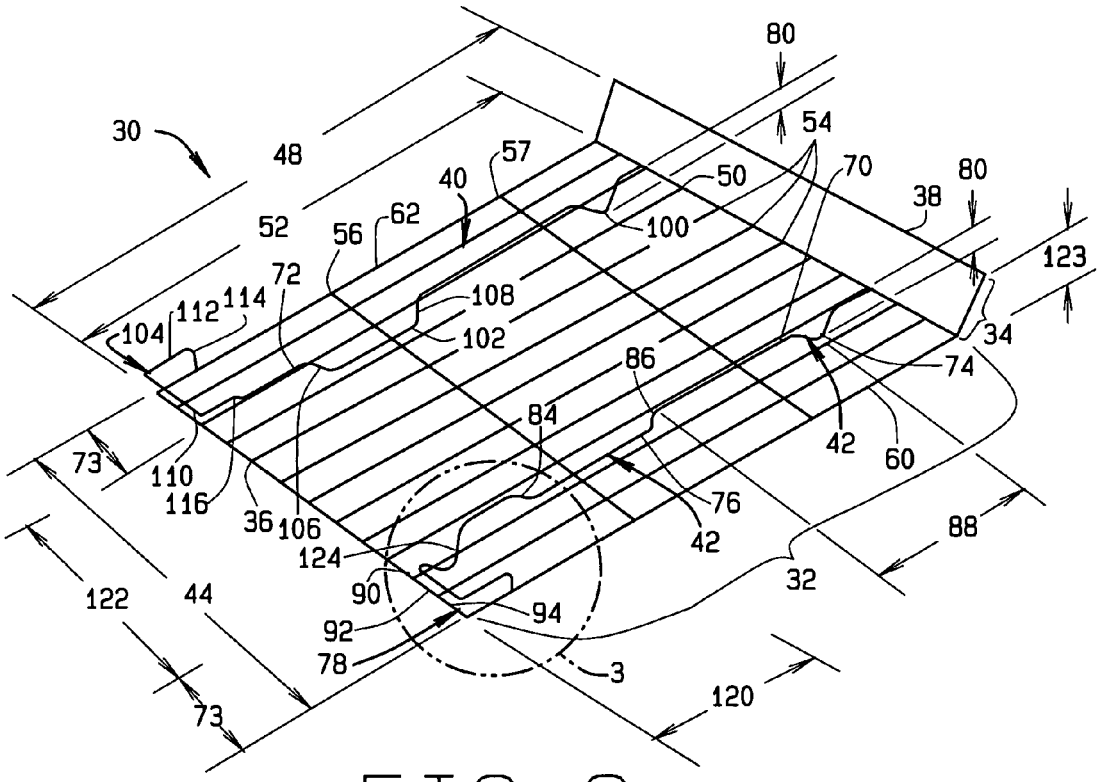
FIG. 2 is a perspective view of an oven rack.

FIG. 2 is a perspective top view of an oven rack 30 including a first portion 32, a second portion 34, a front edge 36, a rear edge 38, a top surface 40, and a bottom surface (not shown in FIG. 2). A support system 42 is attached to oven rack 30 and extends from the bottom surface of oven rack 30. Support system 42 contacts the bottom surface (not shown in FIG. 2) of the cooking chamber (not shown in FIG. 2) when oven rack 30 is installed in oven 10 (shown in FIG. 1).

Oven rack 30 is removably installed within the cooking chamber (not shown in FIG. 2) such that support system 42 contacts the bottom surface of the cooking chamber to support oven rack 30. Oven rack 30 has a width 44 and a depth 48. Width 44 is less than a width (not shown in FIG. 2) of the cooking chamber and also less than a width (not shown) of the cooking racks configured to be received in the shelving slots (not shown in FIG. 2) disposed within the cooking chamber sidewalls (not shown in FIG. 2). Depth 48 extends from oven rack front edge 36 to oven rack rear edge 38. In a particular embodiment, depth 48 is approximately 14⅞ inches and width 44 is selected to accommodate the width of cooking chamber of oven 10, which of course varies with oven size. In further embodiments, depth 48 may also be varied to accommodate a depth of a particular oven chamber.

First portion 32 is substantially flat and extends from front edge 36 to a divider 50 for a variable length 52 that in a particular embodiment, approaches depth 48. Oven rack 30 includes a plurality of wire rods 54 extending from front edge 36 to divider 50. Rods 54 are substantially parallel to each other and are substantially co-planar. Oven rack 30 also includes a pair of support rods 56 and 57 attached substantially perpendicularly to wire rods 54 and extending from a first side edge 60 of oven rack 30 to a second side edge 62 of oven rack 30.

Support system 42 includes a first support member 70 and a second support member 72. First and second support members 70 and 72, respectively, are attached to divider 50 and extend substantially parallel to wire rods 54 from divider 50 to oven rack front edge 36. First support member 70 is attached to divider 50 a distance 73 from oven rack first side edge 60 and includes a first extension 74, a second extension 76, and a handle 78. First extension 74 extends from first support member 70 a distance 80 from the bottom surface of oven rack 30 and is triangular in shape. Second extension 76 extends a distance 80 from the bottom surface of oven rack 30 and includes a front leg 84 and a rear leg 86 which are connected. Second extension 76 is a distance 88 from first extension 74. Rear leg 86 is positioned between front leg 84 and first extension 74. Front leg 84 is positioned a distance 73 from oven rack first side edge 60 and extends to form handle 78. First support member handle 78 includes a first portion 90, a second portion 92, and a third portion 94.

Second support member 72 is constructed identically to first support member 70 and is attached to divider 50 a distance 73 from oven rack second side edge 62. Second support member 72 includes a first extension 100, a second extension 102, and a handle 104. First extension 100 extends from second support member 72 a distance 80 away from the bottom surface of oven rack 30. Second extension 102 extends a distance 80 away from the bottom surface of oven rack 30 and includes a front leg 106 and a rear leg 108 which are connected. Second extension 102 is distance 88 from first extension 100. Rear leg 108 is positioned between front leg 106 and first extension 100. Front leg 106 is positioned a distance 73 from oven rack second side edge 62 and extends to form handle 104.

Second support member handle 104 includes a first portion 110, a second portion 112, and a third portion 114. An S-curve 116 extends between front leg 106 and handle 104. First portion 110 extends from S-curve 116 away from oven rack top surface 40 a distance 117 to second portion 112. Second portion 112 is L-shaped and extends between first portion 110 and third portion 114 and is generally parallel to oven rack top surface 40. Third portion 94 is attached to oven rack second side edge 62 and extends from oven rack top surface 40 a distance 117 to second portion 112.

First support member front leg 84 and second support member front leg 106 are located a distance 120 from oven rack front edge 36 and front leg 84 and front leg 106 are separated by a distance 122. If oven rack 30 is inadvertently tilted forward such that support system rear extensions 74 and 100 are elevated above the cooking chamber bottom surface (not shown in FIG. 2) while support system front extensions 76 and 102 remain in contact with the surface, distance 120 permits oven rack front edge 36 to contact the surface and limit the amount of tilting of oven rack 30.

Oven rack second portion 34 extends away from first portion 32 along divider 50 between portions 76 and 78. Second portion 34 is configured such that when oven rack 30 is installed within the cooking chamber, second portion 34 extends away from first portion top surface 40 a distance 123 towards the cooking chamber back wall (not shown in FIG. 2). In a particular embodiment, distance 123 is approximately 1 inch. When oven rack 30 is fully inserted within the cooking chamber, rear edge 38 contacts the back wall (not shown in FIG. 1) of the cooking chamber.

Figure 3:
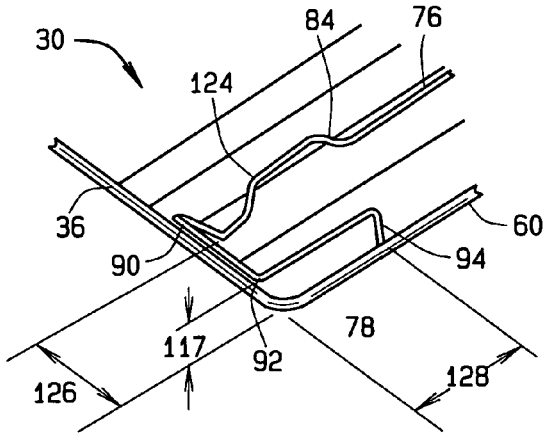
FIG. 3 is an enlarged perspective view of the oven rack taken along area 3 of FIG. 2.

FIG. 3 is an enlarged perspective view of oven rack 30 taken along area 3 of FIG. 2 and illustrates handle 78 to which handle 104 is substantially similar. Handles 104 and 78 permit a user to easily grasp oven rack 30 while installing or removing oven rack 30 from oven 10.

An S-curve 124 extends between front leg 84 and handle 78. First portion 90 extends from S-curve 124 away from oven rack top surface 40 a distance 117 to second portion 92. First portion 90 is a distance 126 from oven rack first side edge 60. Second portion 92 is L-shaped and extends between first portion 90 and third portion 94 and is generally parallel to oven rack top surface 40. Third portion 94 is attached to oven rack first side edge 60 a distance 128 from oven rack front edge 36 and extends from oven rack top surface 40 a distance 117 to second portion 92. In one embodiment, distance 117 is approximately 0.625 inches, distance 126 is approximately 3.375 inches, and distance 128 is approximately 3.375 inches.

Figure 4:
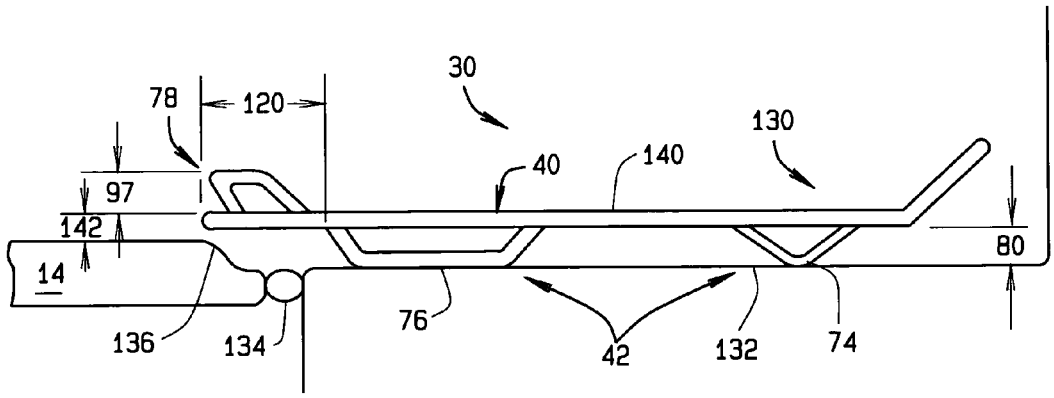
FIG. 4 is a side elevational view of the oven rack shown in FIG. 2 partially installed an oven chamber.

FIG. 4 is a side elevational view of oven rack 30 partially installed in a cooking chamber 130 within oven 10. Cooking chamber 130 includes a bottom surface 132. Oven front door 14 is hingedly attached to oven 10 with a hinge pin 134 and opens to permit access to cooking chamber 130. Door 14 includes a beveled ridge 136 which houses a recessed window 20 (shown in FIG. 1).

Oven rack 30 includes handles 78 and 104 (shown in FIG. 3) which extend a distance 117 above oven rack top surface 40. Support system 42 includes first support member extensions 74 and 76 extending a distance 80 below oven rack bottom surface 140 that permits oven rack 30 to rest on a countertop (not shown) as a trivet for hot cooking utensils (not shown) including pots and pans. Second support member extensions 100 and 102 (not shown in FIG. 4) extend similarly to first support member extensions 74 and 76.

Support system 42 is attached tangentially to oven rack 30 at bottom surface 130 such that extensions 76 and 102 (not shown in FIG. 4) are positioned at a distance 120 from oven rack front edge 36. Extensions 76 and 102 are contact stops which contact beveled ridge 136 to limit sliding movement of oven rack 30 relative to cooking chamber 130 while maintaining contact with cooking chamber bottom surface 132. As a result, extensions 76 and 102 prevent oven rack 30 from being extended from cooking chamber 130 beyond a predetermined distance. Additionally, extensions 76 and 102 stabilize oven rack 30 when oven rack 30 is partially extended from cooking chamber 130.

Handles 78 and 104 (not shown in FIG. 4) and support system 42 are configured such that when oven rack 30 is partially removed from oven 10, handles 78 and 104 are positioned a distance 142 from oven door 14. As such, handles 78 and 104 do not contact oven door 14 and can still be grasped by a user without contacting oven door 14. In a particular embodiment, distance 142 is approximately 0.125 inches.

Figure 5:
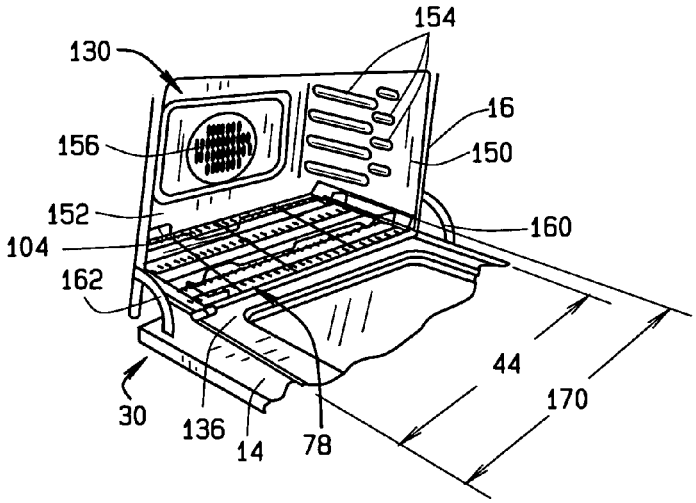
FIG. 5 is a perspective view of the oven rack shown in FIG. 4 partially installed in an oven chamber.

FIG. 5 is a perspective view of oven rack 30 partially extended from oven 10 which includes front door 14, a first side wall 150 and a back wall 152. First side wall 150 includes a plurality of pre-formed shelving slots 154 which receive conventional cooking racks. Back wall 152 includes a convection fan 156. Oven door 14 includes a first hinge guide 160 and a second hinge guide 162 which are connected between oven door 14 and oven front surface 16 to permit oven door 14 to selectively open and close.

Oven rack 30 is removably installed within cooking chamber 130 such that support system 42 (shown in FIGS. 2, 3, and 4) contacts the bottom surface of cooking chamber 130 and supports oven rack 30. Oven rack width 44 is dimensioned to fit within cooking chamber 130 and is therefore less than a width 170 of cooking chamber 130. Oven rack 30 includes support member extensions 76 and 102 (shown in FIG. 2) which are a distance 120 (shown in FIG. 2) from oven rack front edge 36. Extensions 76 and 102 contact beveled ridge 136 to limit an amount of movement in which oven rack 30 is slid from cooking chamber 30 while still maintaining contact with cooking chamber bottom surface 132 (shown in FIG. 4). Additionally, extensions 76 and 102 contact beveled ridge 136 and stabilize oven rack 30 when oven rack 30 is partially extended from cooking chamber 130. When oven rack 30 is tilted such that extensions 76 and 102 are not in contact with cooking chamber bottom surface 132 while extensions 74 and 100 remain in contact with cooking chamber bottom surface 132, oven rack 30 may be slid outward and removed from oven 10.

Figure 6:
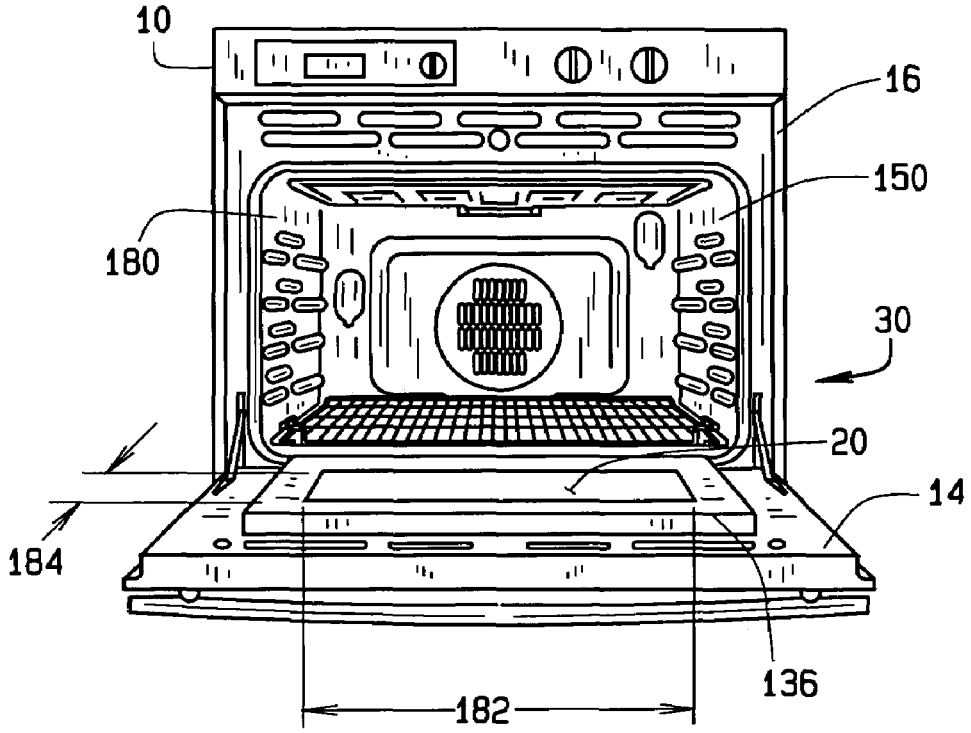
FIG. 6 is a front view of the oven rack shown in FIG. 2 installed in an oven chamber.

FIG. 6 is a front view of oven 10 including an installed oven rack 30. Oven 10 includes front door 14, first side wall 150, and a second side wall 180. Front door 14 is hingedly attached to a front surface 16 and includes beveled ridge 136 which surrounds recessed window 20. Window 20 has a width 182 and a depth 184. Width 182 is approximately equal to distance 122 (shown in FIG. 2) between oven rack support members 70 and 72 (shown in FIG. 2). Depth 184 is approximately equal to distance 88 (shown in FIG. 2) between oven rack support member first extensions 74 and 100 (shown in FIG. 2) and support member second extensions 76 and 102 (shown in FIG. 2). Accordingly, oven rack 30 is sized to fit atop recessed window 20 when oven door 14 is open and beveled ridge 136 prevents oven rack 30 from sliding off window 20.

The above-described oven rack is cost-effective and increases the cooking capacity of an oven. The oven rack includes a first portion and a second portion which unitarily extends from the first portion. A pair of handles unitarily extend from the first portion and permit a user to easily grasp the oven rack while inserting or removing the oven rack from an oven. A support system extends from the first portion and contacts the bottom surface of a cooking chamber when the oven rack is installed in the oven. As such, an oven rack is provided which increases the flexibility and the cooking capacity available to a user.

While the invention has been described in terms of various specific embodiments, those skilled in the art will recognize that the invention can be practiced with modification within the spirit and scope of the claims.

What is claimed is:

1. An oven rack comprising:

a first portion comprising a first side and a second side and a front edge extending therebetween, said first portion having a substantially planar top surface;

a support system attached to said first portion between said first and second sides, said support system comprising at least a first leg and a second leg rearwardly displaced from said first leg, said first and second legs attached to said first portion;

a second portion extending obliquely from said first portion; and at least one handle between said first and second sides, said handle being unitarily formed with said first leg and extending from said first side of said first portion adjacent said front edge.

2. An oven rack in accordance with claim 1 wherein said support system comprises a plurality of legs extending from said first portion.

3. An oven rack in accordance with claim 1 wherein said first portion comprises a plurality of first rods and a plurality of second rods, said first rods extending between said first side of said first portion and said second side of said first portion, said second rods attached substantially perpendicularly to said first rods.

4. An oven rack in accordance with claim 3 wherein said first rods and said second rods are substantially co-planar.

5. An oven rack in accordance with claim 1 wherein said at least one handle comprises two handles extending from said first side of said first portion.

6. An oven rack in accordance with claim 2 wherein said plurality of legs comprises four legs.

7. An oven rack in accordance with claim 2 wherein said oven rack is configured to be used as a trivet on a countertop.

8. An oven comprising:

a cooking chamber comprising a bottom surface, and at least three sides;

an oven rack configured to rest on said bottom surface of said cooking chamber, said oven rack comprising a first portion having a first side and a second side and a front edge extending therebetween, said first portion having a substantially planar top surface;

a support system attached to said oven rack first portion between said first and second sides, said support system comprising at least a first leg and a second leg rearwardly displaced from said first leg, said first and second legs attached to said first portion; and at least one handle between said first and second sides, said handle being unitarily formed with said first leg, extending from said first side of said first portion adjacent said front edge.

9. An oven in accordance with claim 8 wherein said oven rack further comprises a second portion unitarily extending obliquely from said first portion.

10. An oven in accordance with claim 9 wherein said first portion further comprises a plurality of first rods extending from said first side to said second side.

11. An oven in accordance with claim 10 wherein said first portion further comprises a plurality of second rods attached substantially perpendicularly to said plurality of first rods.

12. An oven in accordance with claim 8 wherein said support system comprises a plurality of legs extending from said oven rack.

13. An oven in accordance with claim 12 wherein said plurality of legs comprises four legs.

14. An oven in accordance with claim 9 wherein said at least one handle comprises two handles extending unitarily from said first portion.

15. An oven in accordance with claim 8 wherein said oven rack support system is further configured to prevent said oven rack from over-extending from said cooking chamber.

16. An oven in accordance with claim 8 wherein said cooking chamber further comprises a door hingedly attached to said cooking chamber, said oven rack support system further configured to stabilize said oven rack against said oven door.

17. An oven in accordance with claim 8 wherein said oven rack is configured to be used as a trivet on a countertop.

* * * * *

UNITED STATES PATENT AND TRADEMARK OFFICE

CERTIFICATE OF CORRECTION

PATENT NO. : 6,945,245 B1
APPLICATION NO. : 09/659112
DATED : September 20, 2005
INVENTOR(S) : Wilson It is certified that error appears in the above-identified patent and that said Letters Patent is hereby corrected as shown below:

In Claim 8, column 6, beginning on line 22, delete "leg, extending" and insert therefor -- leg and extending --.

Signed and Sealed this

Eighteenth Day of September, 2007

JON W. DUDAS
*Director of the United States Patent and Trademark Office*